US010716346B2

(12) United States Patent
Chan

(10) Patent No.: US 10,716,346 B2
(45) Date of Patent: Jul. 21, 2020

(54) ADJUSTING STRAP FOR ADJUSTING TUBE ORIFICE DIAMETER OF FLEXIBLE TUBE-SHAPED OBJECT

(71) Applicant: Duraflex Hong Kong Limited, Hong Kong (CN)

(72) Inventor: Man Chak Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/441,495

(22) Filed: Jun. 14, 2019

(65) Prior Publication Data

US 2019/0380411 A1 Dec. 19, 2019

(30) Foreign Application Priority Data

Jun. 15, 2018 (CN) ..... 2018 1 0619353

(51) Int. Cl.
*A41F 1/00* (2006.01)
*A41D 27/10* (2006.01)
*A44B 18/00* (2006.01)

(52) U.S. Cl.
CPC ..... *A41F 1/002* (2013.01); *A41D 27/10* (2013.01); *A44B 18/0069* (2013.01); *A41D 2300/32* (2013.01); *A44D 2203/00* (2013.01); *A44D 2205/00* (2013.01)

(58) Field of Classification Search
CPC ..... A41F 1/002; A41F 17/04; A41D 27/10; A41D 2300/32; A41D 2203/00; A41D 2205/00; A44B 18/0069
USPC ..... 24/16 PB
See application file for complete search history.

(56) References Cited

U.S. PATENT DOCUMENTS 5,820,000 A * 10/1998 Timberlake ..... A01M 31/004 224/219
6,687,916 B2 * 2/2004 Thompson ..... A44C 5/0007 2/16
7,305,718 B2 * 12/2007 Avallone ..... A41D 19/01582 2/11
2014/0245784 A1 * 9/2014 Proud ..... A44C 5/0015 63/1.11
2015/0257493 A1 * 9/2015 Skipper ..... A44B 11/22 2/322
2016/0324225 A1 * 11/2016 Pollack ..... A41D 1/08
2018/0213895 A1 * 8/2018 Green ..... A44C 5/0053
(Continued)

*Primary Examiner* — Robert Sandy
*Assistant Examiner* — Rowland Do
(74) *Attorney, Agent, or Firm* — Collard & Roe, P.C.

(57) ABSTRACT

An adjusting strap adjusts the tube orifice diameter of a flexible tube-shaped object and has an inner annular wall, an outer annular wall, and an interlayer between the inner annular wall and the outer annular wall. The adjusting strap has a head portion, a tail portion, and a flexible rope strap portion between the head portion and the tail portion. The tail portion comprises a tail housing, and an avoidance hole passing through the tail housing and available for the head portion and the rope strap portion to pass through. When the adjusting strap is mounted in the flexible tube-shaped object, the head portion passes through the avoidance hole and penetrates the outer annular wall of the flexible tube-shaped object, the rope strap portion is partially received in the interlayer, and the tail portion is completely received in the interlayer and is connected to the flexible tube-shaped object.

10 Claims, 3 Drawing Sheets

(56) References Cited

U.S. PATENT DOCUMENTS

| | | | | |
|---|---|---|---|---|
| 2019/0029373 | A1* | 1/2019 | Shaffer | A44C 5/0053 |
| 2019/0128374 | A1* | 5/2019 | Cruise | A44C 5/0053 |
| 2020/0000194 | A1* | 1/2020 | Jandali | A44C 5/0053 |
| 2020/0029661 | A1* | 1/2020 | Tobiassen | A44C 5/2066 |

* cited by examiner

ADJUSTING STRAP FOR ADJUSTING TUBE ORIFICE DIAMETER OF FLEXIBLE TUBE-SHAPED OBJECT

CROSS-REFERENCE TO RELATED APPLICATIONS

This application claims priority under 35 USC 119 of Chinese Application No. 201810619353.8, filed on Jun. 15, 2018, the disclosure of which is herein incorporated by reference.

TECHNICAL FIELD

The present invention relates to the technical field of tube orifice diameter adjustment, and specifically relates to an adjusting strap for adjusting the tube orifice diameter of a flexible tube-shaped object.

BACKGROUND ART

In order to make the tube orifice diameter of a clothes sleeve adjustable, a layer of loop face of a hook and loop type fastener is often placed on the outer side of the sleeve and a pull piece provided with a hook face of the hook and loop fastener is sewn on the outer side of the sleeve by means of machine sewing. When a user wants to adjust the tube orifice diameter of the sleeve, the user needs to fix the sleeve while pulling the pull piece, so that the tube orifice diameter of the sleeve can be well adjusted. In the situation in which no finger is used for assistance in fixing the sleeve, the sleeve rotates toward the pulling direction, resulting in the hook face of the hook and loop fastener on the pull piece being difficult to align with the loop face of the hook and loop fastener on the sleeve. In this case, only until the sleeve rotates to a position where it cannot further rotate toward the pulling direction can the hook face of the hook and loop fastener on the pull piece be attached to the loop face of the hook and loop fastener on the sleeve, so as to constrict the tube orifice. However, the appearance of the constricted tube orifice after the rotation lacks aesthetics, and the tube orifice will spring back after being pulled, resulting in the tube orifice becoming loose Therefore, the tube orifice cannot be effectively constricted to an appropriate size. Moreover, the portion of the pull piece that exceeds the loop face of the hook and loop fastener is usually not stored in any manner but left hanging outside. In this case, the portion of the pull piece that extends beyond the loop face of the hook and loop fastener can easily be rubbed, resulting in the pull piece being separated from the sleeve and the tube orifice becoming loose.

SUMMARY OF THE INVENTION

In view of the above-described problems in the art, it is an object of the present invention to provide an adjusting strap for adjusting the tube orifice diameter of a flexible tube-shaped object, wherein the advantages of the adjusting strap are as follows: after the adjusting strap is mounted in the tube orifice of the flexible tube-shaped object, one just needs to pull the adjusting strap without fixing the tube orifice of the flexible tube-shaped object at the same time, to ensure that the tube orifice of the flexible tube-shaped object only shrinks toward the center and does not rotate along the direction of pulling the adjusting strap, thereby facilitating one-hand operation by a user. Moreover, the redundant portion of the adjusting strap is also stored by means of attachment, thereby not only preserving the aesthetics but also reducing the probability of the adjusting strap being subject to external rubbing. The flexible tube-shaped object herein can be a sleeve, a trouser leg, a backpack, a cloth bag, and the like.

The present invention solves the problems of the prior art by providing an adjusting strap for adjusting the tube orifice diameter of a flexible tube-shaped object, wherein the flexible tube-shaped object has a dual-layer structure and has an inner annular wall and an outer annular wall, and an interlayer is formed between the inner annular wall and the outer annular wall. The adjusting strap comprises a head portion, a tail portion, and a flexible rope strap portion of which the two ends are respectively connected to the head portion and the tail portion. The tail portion comprises a second housing, and an avoidance hole passing through the second housing and available for the head portion and the rope strap portion to pass through is disposed on the second housing. When the adjusting strap is mounted in the flexible tube-shaped object, the head portion passes through the avoidance hole and penetrates the outer annular wall of the flexible tube-shaped object, the rope strap portion is partially received in the interlayer, and the tail portion is completely received in the interlayer and is connected to the flexible tube-shaped object.

In the adjusting strap of the present invention, the head portion comprises a first housing and a magnetic member built in the first housing, the tail portion comprises a positioning member built in the second housing and available for the attachment of the magnetic member, and the avoidance hole is located between the positioning member and the rope strap portion.

In the adjusting strap of the present invention, the second housing is made of a flexible material. Preferably, the second housing comprises an intermediate sheet provided with multiple receiving grooves arranged at intervals and the positioning member comprises multiple metal bars magnetically attachable to the magnetic member, and the multiple metal bars are respectively received in the multiple receiving grooves.

In the adjusting strap of the present invention, the avoidance hole is disposed on the intermediate sheet. The second housing further comprises a front sheet, and the front sheet is attached to the intermediate sheet and covers all of the receiving grooves.

The magnetic member can be a circular magnet, and the metal bar can be an iron bar.

In one embodiment, the first attachment member is disposed on the outer side of the head portion, a second attachment member is disposed on the outer side of the outer annular wall, and when the adjusting strap is mounted in the flexible tube-shaped object, the first attachment member faces the second attachment member.

The first attachment member can be a hook face of the hook and loop, and the second attachment member can be a loop face of the hook and loop.

In one embodiment, a prepared hole passing through the outer annular wall is disposed on the outer annular wall, and when the adjusting strap is mounted in the flexible tube-shaped object, the avoidance hole is aligned with the prepared hole, and the head portion penetrates the outer annular wall from the prepared hole.

The implementation of the adjusting strap provided by the present invention can achieve the following beneficial effects: the adjusting strap is used to adjust the tube orifice diameter of a flexible tube-shaped object, wherein the flexible tube-shaped object has a dual-layer structure and has an inner annular wall and an outer annular wall, and an interlayer is formed between the inner annular wall and the outer annular wall; the adjusting strap comprises a head portion, a tail portion, and a flexible rope strap portion of which the two ends are respectively connected to the head portion and the tail portion; the tail portion comprises a second housing; an avoidance hole passing through the second housing and available for the head portion and the rope strap portion to pass through is disposed on the second housing; and when the adjusting strap is mounted in the flexible tube-shaped object, the head portion passes through the avoidance hole and penetrates the outer annular wall of the flexible tube-shaped object, the rope strap portion is partially received in the interlayer, and the tail portion is completely received in the interlayer and is connected to the flexible tube-shaped object. In this way, after the adjusting strap is mounted in the tube orifice of the flexible tube-shaped object, one just needs to pull the adjusting strap without fixing the tube orifice of the flexible tube-shaped object at the same time, to ensure that the tube orifice of the flexible tube-shaped object only shrinks toward the center and does not rotate along the direction of pulling the adjusting strap, thereby facilitating one-hand operations of the user.

DETAILED DESCRIPTION OF THE EMBODIMENTS

In order to understand the technical features, objectives and effects of the present invention more clearly, the particular embodiments of the present invention are described herein in detail with reference to the drawings. The described embodiments are merely some rather than all of the embodiments of the present invention. Based on the embodiments of the present invention, all other embodiments obtained by a person of ordinary skill in the art without making any inventive effort shall fall within the protection scope of the present invention.

Embodiment 1

Figure 1:
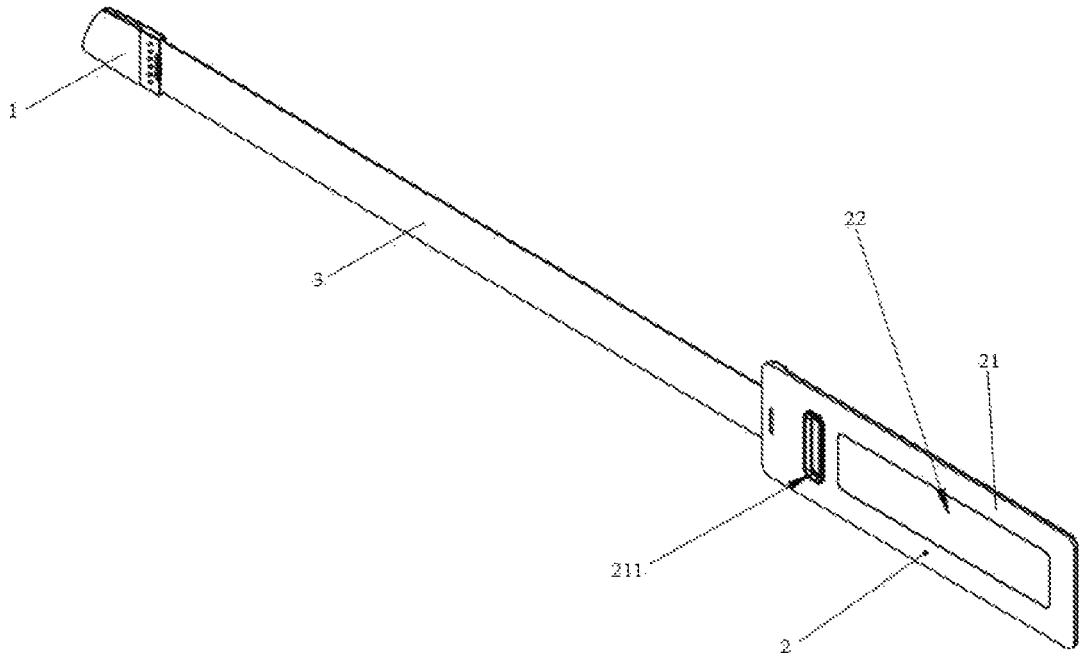
FIG. 1 is a three-dimensional assembled diagram of one embodiment of the present invention.
Figure 2:
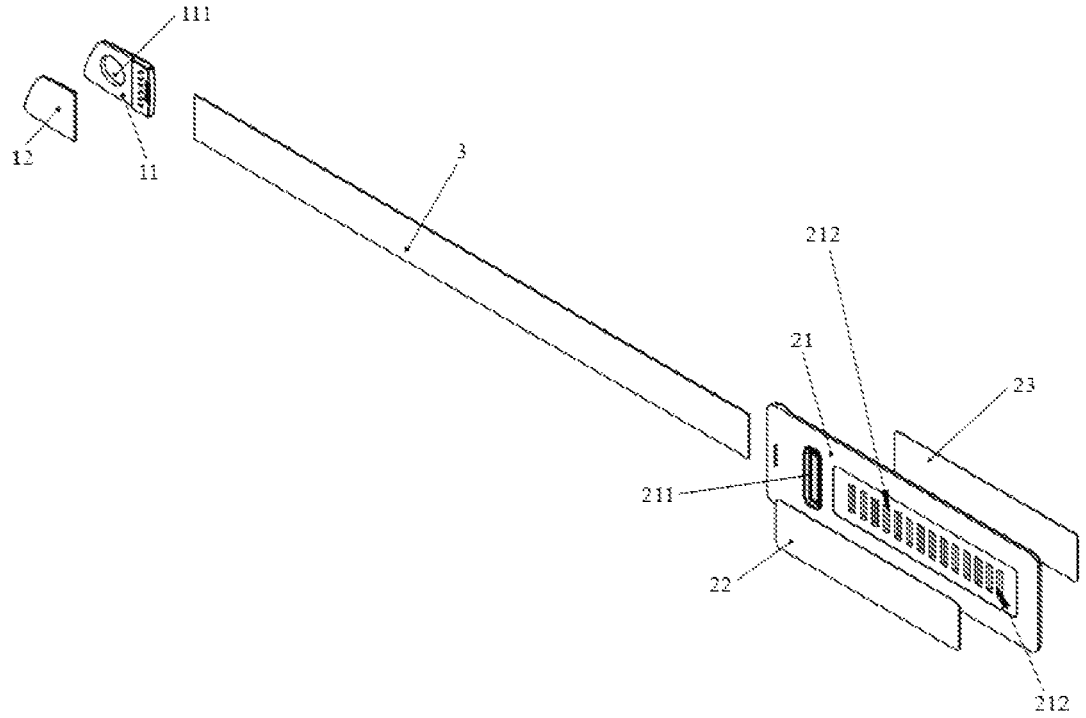
FIG. 2 is a three-dimensional exploded diagram of the embodiment of FIG. 1.

FIG. 1 and FIG. 2 show a preferred embodiment of an adjusting strap for adjusting the tube orifice diameter of a flexible tube-shaped object 4 provided by the present invention.

The adjusting strap comprises a head portion 1, a tail portion 2, and a flexible rope strap portion 3 of which the two ends are respectively connected to the head portion 1 and the tail portion 2, wherein the tail portion 2 comprises a tail housing, and an avoidance hole 211 passing through the tail housing and available for the head portion 1 and the rope strap portion 3 to pass through is disposed on the second housing. In this embodiment, the head portion 1 comprises a head housing, the head housing comprises a base body 11, the base body 11 is made of plastic, the rope strap portion 3 is flat noodle-shaped, the tail housing comprises an intermediate sheet 21, the intermediate sheet 21 can be made of plastic, and the base body 11, the rope strap portion 3 and the intermediate sheet 21 are integrated as a whole by means of injection molding during production. The avoidance hole 211 passing through the intermediate sheet 21 is disposed at the side of the intermediate sheet 21 that is close to the rope strap portion 3, and the size of the avoidance hole 211 is designed to be available for the head portion 1 and the rope strap portion 3 to pass through.

It should be noted that, the flexible tube-shaped object 4 has a dual-layer structure and has an inner annular wall 42 and an outer annular wall 41, and an interlayer 43 is formed between the inner annular wall 42 and the outer annular wall 41. A prepared hole passing through the outer annular wall 41 is disposed on the outer annular wall 41, and the overall dimension of the prepared hole is the same as the overall dimension of the avoidance hole 211. In this embodiment, the flexible tube-shaped object 4 is a sleeve, the inner annular wall 42 is the inner side cloth of the sleeve, and the outer annular wall 41 is the outer side cloth of the sleeve.

Figure 3:
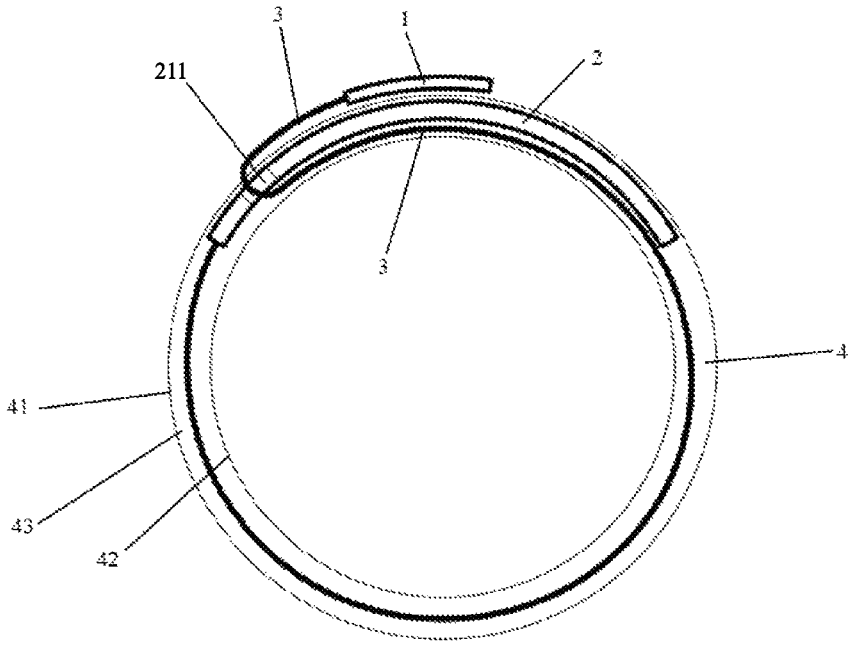
FIG. 3 is a schematic diagram of a first state of the embodiment of FIG. 1 in combination with a flexible tube-shaped object.

Referring to FIG. 3, when the adjusting strap is mounted to the flexible tube-shaped object 4, the tail portion 2 is completely received in the interlayer 43 and is connected to the outer annular wall 41 of the flexible tube-shaped object 4 by means of machine sewing, the avoidance hole 211 on the intermediate sheet 21 of the tail portion 2 is aligned with the prepared hole, the head portion 1 passes through the avoidance hole 211 and penetrates the prepared hole of the outer annular wall 41 of the flexible tube-shaped object 4 to be pulled by a user, and the rope strap portion 3 is coiled into a loop and is partially received in the interlayer 43.

In this way, when the user wants to constrict the tube orifice of the flexible tube-shaped object 4, the user just needs to pull the head portion 1 which is exposed outside the flexible tube-shaped object 4, the head portion 1 drives the rope strap portion 3 to shrink, so that the tube orifice of the flexible tube-shaped object 4 shrinks therewith. Because the tail portion 2 is connected to the flexible tube-shaped object 4 and the rope strap portion 3 can freely move relative to the flexible tube-shaped object 4, when the rope strap portion 3 is pulled, the tube orifice of the flexible tube-shaped object 4 does not rotate toward the pulling direction, thereby facilitating implementation of effectively constricting the tube orifice of the flexible tube-shaped object 4 by one hand of the user.

Further, the head portion 1 comprises a first housing and a magnetic member built in the first housing, the tail portion 2 comprises a positioning member built in the second housing and available for the attachment of the magnetic member, and the avoidance hole 211 is located between the positioning member and the rope strap portion 3. Specifically, the magnetic member uses a circular magnet and a circular groove 111 is recessed at one side of the base body 11 of the first housing. The magnetic member is embedded in the groove 111. The first housing further comprises a cover sheet 12 made of a PU plastic sheet. The cover sheet 12 is connected to one side of the base body 11 by means of hot melting and covers the groove 111 to prevent the magnetic member from falling off. The intermediate sheet 21 of the second housing is made of a flexible material and has the performance of flexibility. Multiple parallel receiving grooves 212 arranged at equal intervals are disposed at the front side of the intermediate sheet 21. The positioning member comprises multiple metal bars magnetically attachable to the magnetic member. The metal bars can be made of iron (certainly, in other embodiments, a cobalt bar, a nickel bar, and the like can also be used). The number of the metal bars is consistent with the number of receiving grooves 212, and each of the receiving grooves 212 receives one of the metal bars. The tail housing further comprises a front sheet 22 made of a PU plastic sheet, and the front sheet 22 is connected to the front side of intermediate sheet 21 by means of hot melting and covers all of the receiving grooves 212 to prevent the metal bars from falling off.

Figure 4:
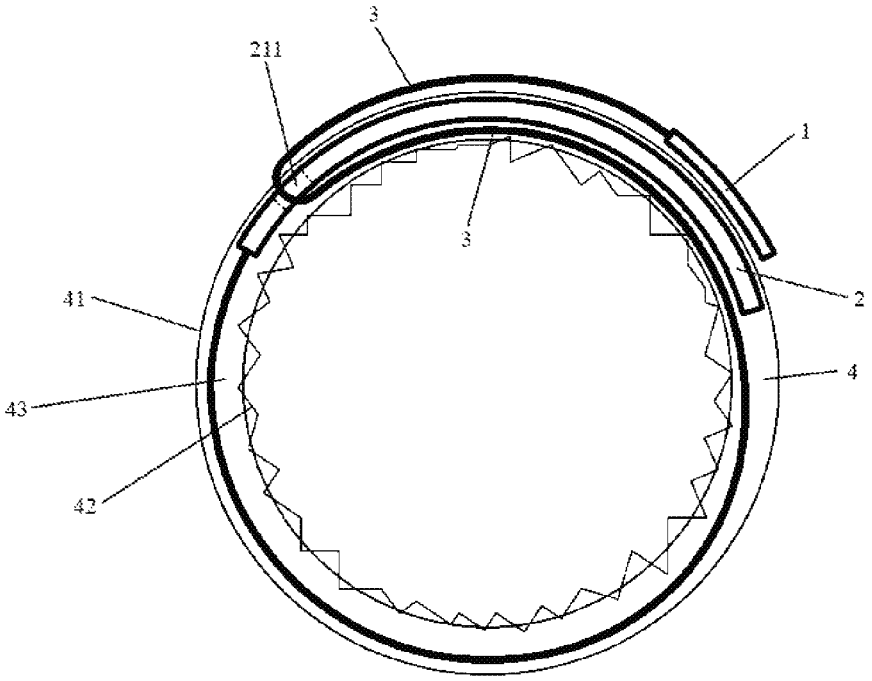
FIG. 4 is a schematic diagram of a second state of the embodiment of FIG. 1 in combination with the flexible tube-shaped object.

Therefore, after the user pulls the head portion 1 to constrict the tube orifice of the flexible tube-shaped object 4, the user can attach the head portion 1 to the tail portion 2 by means of the magnetic attraction force (see FIG. 4). In this way, the head portion 1 and a portion of the rope strap portion 3 which are pulled to the outer side of the tube orifice of the flexible tube-shaped object 4 can be well stored, thereby ensuring aesthetics of the appearance of the constricted tube orifice of the flexible tube-shaped object 4, and, more importantly, significantly reducing the probability of the head portion 1 and the portion of the rope strap portion 3 which are pulled to the outer side of the tube orifice of the flexible tube-shaped object 4 being subject to external interference or scraping, and effectively ensuring the stability of the constricted tube orifice of the flexible tube-shaped object 4.

Further, the tail housing further comprises a rear sheet 23 made of a PU plastic sheet connected to the rear side of intermediate sheet 21 by means of hot melting and being aligned with the front sheet 22. In this way, the structure of the tail housing is more stable, so as to prevent the intermediate sheet 21 from breaking due to a large area of receiving grooves 212 being disposed in the middle thereof.

Embodiment 2

This embodiment has all of the features of the first embodiment, except that instead of magnets, a hook and loop fastener is used. In this embodiment, with the reference numerals referring to the same elements described above, the adjusting strap comprises a head portion 1, a tail portion 2, and a flexible rope strap portion 3 of which the two ends are respectively connected to the head portion 1 and the tail portion 2, wherein the tail portion 2 comprises a tail housing, and an avoidance hole 211 passing through the tail housing and available for the head portion 1 and the rope strap portion 3 to pass through is disposed on the tail housing. In this embodiment, the head portion 1 comprises a base body 11, the base body 11 is made of plastic, the rope strap portion 3 is flat noodle-shaped, and the tail portion 2 comprises an intermediate sheet 21. The intermediate sheet 21 can be made of plastic, and the base body 11, the rope strap portion 3 and the intermediate sheet 21 are integrated as a whole by means of injection molding during production. The avoidance hole 211 passing through the intermediate sheet 21 is disposed at the side of the intermediate sheet 21 that is close to the rope strap portion 3, and the size of the avoidance hole 211 is designed to be available for the head portion 1 and the rope strap portion 3 to pass through.

A first attachment member 13 is disposed on the outer side of the head portion 1, and a second attachment member 411 is disposed on the outer side of the outer annular wall 41. The first attachment member 13 is a hook face of the hook and loop fastener, and the second attachment member 411 is a loop face of the hook and loop fastener. Certainly, in other embodiments, the first attachment member 13 can be a loop face of the hook and loop fastener, and the second attachment member 411 can be a hook face of the hook and loop fastener.

It should be noted that, the flexible tube-shaped object 4 has a dual-layer structure and has an inner annular wall 42 and an outer annular wall 41, and an interlayer 43 is formed between the inner annular wall 42 and the outer annular wall 41. A prepared hole passing through the outer annular wall 41 is disposed on the outer annular wall 41, and the overall dimension of the prepared hole is the same as the overall dimension of the avoidance hole 211. In this embodiment, the flexible tube-shaped object 4 is a sleeve, the inner annular wall 42 is the inner side cloth of the sleeve, and the outer annular wall 41 is the outer side cloth of the sleeve.

When the adjusting strap is mounted to the flexible tube-shaped object 4, the tail portion 2 is completely received in the interlayer 43 and is connected to the position of the second attachment member 411 of the outer annular wall 41 of the flexible tube-shaped object 4 by means of machine sewing, the avoidance hole 211 on the intermediate sheet 21 of the tail portion 2 is aligned with the prepared hole, the head portion 1 passes through the avoidance hole 211 and penetrates the prepared hole of the outer annular wall 41 of the flexible tube-shaped object 4 to be pulled by the user, the first attachment member 13 of the head portion 1 can be attached to the second attachment member 411, and the rope strap portion 3 is coiled into a loop and is partially received in the interlayer 43.

Figure 5:
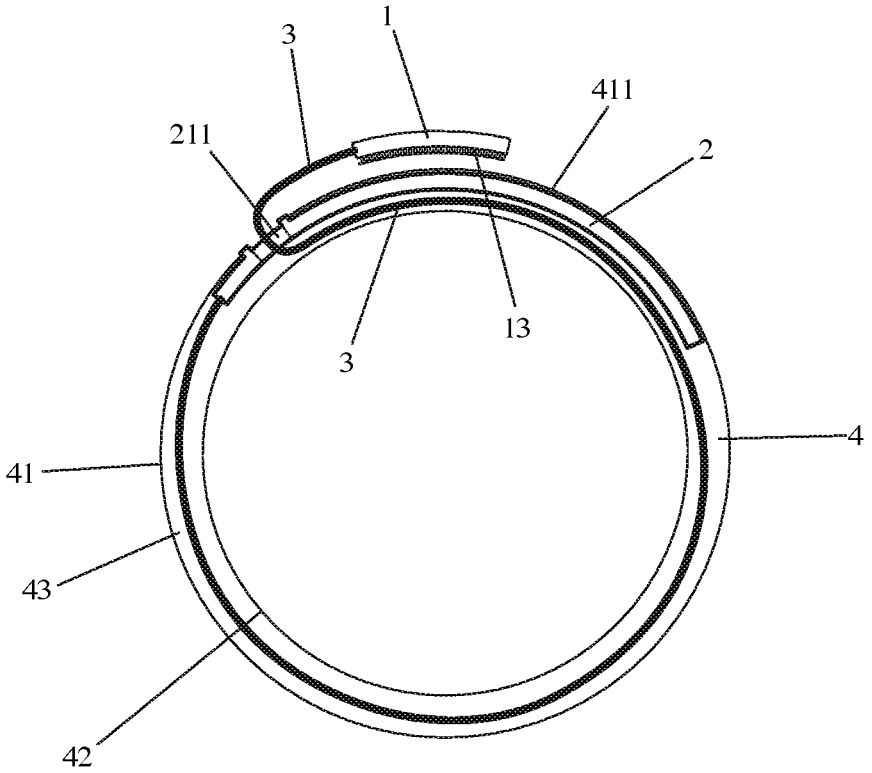
FIG. 5 is a schematic diagram of a state of a second embodiment of the invention in combination with the flexible tube-shaped object.

Thus, after the user pulls the head portion 1 to constrict the tube orifice of the flexible tube-shaped object 4, the user can attach the head portion 1 to the tail portion 2 by means of the hook and loop (see FIG. 5). In this way, the head portion 1 and a portion of the rope strap portion 3 which are pulled to the outer side of the tube orifice of the flexible tube-shaped object 4 can be well stored, thereby ensuring aesthetics of the appearance of the constricted tube orifice of the flexible tube-shaped object 4, more importantly, significantly reducing the probability of the head portion 1 and the portion of the rope strap portion 3 which are pulled to the outer side of the tube orifice of the flexible tube-shaped object 4 being subject to external interference or scraping, and effectively ensuring the stability of the constricted tube orifice of the flexible tube-shaped object 4.

The embodiments of the present invention are described above with reference to the drawings. However, the present invention is not limited to the foregoing particular embodiments. The foregoing particular embodiments are merely for illustration rather than limitation. In light of the teachings of the present invention, a person of ordinary skill in the art may further use various forms without departing from the spirit and the protection scope of the claims of the present invention, and these forms all fall within the protection scope of the present invention.

Description of reference numerals in the particular embodiments:

| | | | |
|---|---|---|---|
| Head portion | 1 | Tail portion | 2 |
| Rope strap portion | 3 | Base body | 11 |
| Cover sheet | 12 | Groove | 111 |
| Intermediate sheet | 21 | Front sheet | 22 |
| Rear sheet | 23 | Avoidance hole | 211 |
| Receiving groove | 212 | Flexible tube-shaped object | 4 |
| Outer annular wall | 41 | Inner annular wall | 42 |
| Interlayer | 43 | First attachment member | 13 |
| Second attachment member | 411 | | |

What is claimed is:

1. A flexible tube-shaped object having a dual-layer structure and comprising:

an inner annular wall, an outer annular wall, an interlayer being formed between the inner annular wall and the outer annular wall, and an adjusting strap for adjusting a tube orifice diameter of the flexible tube-shaped object, the adjusting strap comprising:

a head portion, a tail portion, and a flexible rope strap portion having two ends respectively connected to the head portion and the tail portion, wherein the tail portion comprises a tail housing having an avoidance hole passing through the tail housing and available for the head portion and the rope strap portion to pass through, wherein the head portion passes through the avoidance hole and penetrates the outer annular wall of the flexible tube-shaped object, the rope strap portion is partially received in the interlayer, and the tail portion is completely received in the interlayer and is connected to the flexible tube-shaped object.

2. The flexible tube-shaped object according to claim 1, wherein the head portion comprises a head housing and a magnetic member built in the head housing, the tail portion comprises a positioning member built in the tail housing and configured for the attachment of the magnetic member, and the avoidance hole is located between the positioning member and the rope strap portion.

3. The flexible tube-shaped object according to claim 2, wherein the tail housing is made of a flexible material.

4. The flexible tube-shaped object according to claim 2, wherein the tail housing comprises an intermediate sheet having multiple receiving grooves arranged at intervals, wherein the positioning member comprises multiple metal bars magnetically attachable to the magnetic member, and the multiple metal bars are respectively received in the multiple receiving grooves.

5. The flexible tube-shaped object according to claim 4, wherein the avoidance hole is disposed on the intermediate sheet.

6. The flexible tube-shaped object according to claim 4, wherein the tail housing further comprises a front sheet, and the front sheet is attached to the intermediate sheet and covers all of the receiving grooves.

7. The flexible tube-shaped object according to claim 4, wherein the magnetic member is a circular magnet, and the metal bars are iron bars.

8. The flexible tube-shaped object according to claim 1, further comprising a first attachment member disposed on an outer side of the head portion, a second attachment member is disposed on an outer side of the outer annular wall, wherein when the adjusting strap is mounted in the flexible tube-shaped object, the first attachment member faces the second attachment member.

9. The flexible tube-shaped object according to claim 8, wherein the first attachment member is a hook face of a hook and loop fastener, and the second attachment member is a loop face of the hook and loop fastener.

10. The flexible tube-shaped object according to claim 1, wherein when the adjusting strap is mounted in the flexible tube-shaped object, the avoidance hole is aligned with a prepared hole in the outer annular wall, and the head portion is configured to penetrate the outer annular wall from the prepared hole.

* * * * *